US005711444A

United States Patent [19]

Meacham et al.

[11] Patent Number: 5,711,444

[45] Date of Patent: Jan. 27, 1998

[54] TRANSPORT CHAMBER

[75] Inventors: Patrick E. Meacham, Lakeville; Mark W. Wallace, Minneapolis; Carl Nyberg, Bloomington, all of Minn.; William W. Thompson, Midlothian, Va.; Miles Conrad Huffstutler, Liberty Hill, Tex.

[73] Assignee: Temp Top Container Systems, Inc., Minneapolis, Minn.

[21] Appl. No.: 695,610

[22] Filed: Aug. 12, 1996

Related U.S. Application Data

[63] Continuation of Ser. No. 372,192, Jan. 13, 1995, Pat. No. 5,601,202, which is a continuation-in-part of Ser. No. 178, 189, Jan. 6, 1994, Pat. No. 5,558,241.

[51] Int. Cl.[6] ..... P65D 6/116

[52] U.S. Cl. ..... 220/6; 220/1.5; 220/4.31; 220/682

[58] Field of Search ..... 220/4.28, 4.31, 220/4.32, 4.33, 1.5, 682, 691, 6

[56] References Cited

U.S. PATENT DOCUMENTS

| | | | |
|---|---|---|---|
| 886,530 | 5/1908 | Mestemacher . | |
| 1,931,397 | 10/1933 | Smith . | |
| 3,266,656 | 8/1966 | Kirdle | 220/4.33 |
| 3,854,269 | 12/1974 | Hancock | 52/754 |
| 3,940,007 | 2/1976 | Grifiths | 220/4.33 |
| 3,974,616 | 8/1976 | Beckley | 220/682 |
| 3,989,157 | 11/1976 | Veenema | 220/4.33 |
| 4,000,827 | 1/1977 | Emery | 220/1.5 |
| 4,165,024 | 8/1979 | Oswalt et al. | 220/4.28 |
| 4,221,302 | 9/1980 | Kupersmit | 220/4.31 |
| 4,456,142 | 6/1984 | Burling | 220/4 |
| 4,591,065 | 5/1986 | Foy | 220/7 |
| 4,673,087 | 6/1987 | Webb | 220/4.33 |
| 4,693,386 | 9/1987 | Hughes et al. | 220/1.5 |
| 4,809,851 | 3/1989 | Oestreich, Jr. | 206/599 |
| 4,936,615 | 6/1990 | Moore | 294/68.1 |
| 5,070,577 | 12/1991 | Bonneville et al. | 16/260 |
| 5,161,709 | 11/1992 | Oestreich, Jr. | 220/6 |
| 5,204,149 | 4/1993 | Phenicie et al. | 220/1.5 |
| 5,236,099 | 8/1993 | Fties et al. | 220/1.5 |
| 5,253,763 | 10/1993 | Kirkley et al. | 206/600 |
| 5,263,339 | 11/1993 | Evans | 62/457.7 |

FOREIGN PATENT DOCUMENTS

| | | | |
|---|---|---|---|
| 87978 | 3/1992 | Japan | 220/4.28 |
| WO 94/01333 | 1/1994 | WIPO . | |

*Primary Examiner*—Tony G. Soohoo
*Attorney, Agent, or Firm*—Kinney & Lange, P.A.

[57] ABSTRACT

A transport container having a base and a plurality of side walls perpendicularly connected to form a container having an inner cavity. The side walls are formed of first and second wall panels. The first and second wall panels are hingedly connected so that the first or upper wall panels may fold down relative to the second or lower wall panels to collapse the transport container after use. The first and second wall panels are hingedly connected by an elongated flexible hinge. Edge portions of the first wall panels have coupling assemblies that are designed to selectively connect and disconnect adjacent first wall panels.

19 Claims, 11 Drawing Sheets

Fig. 3a
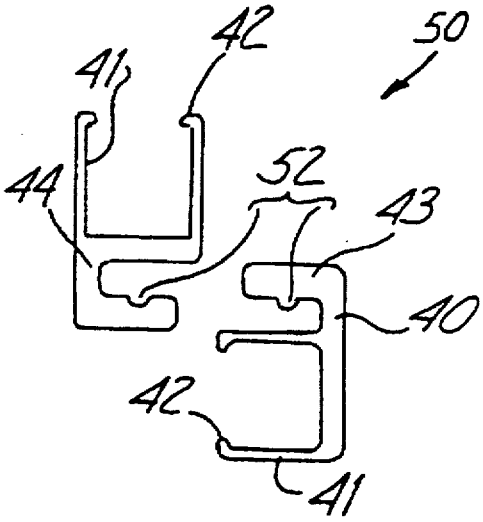
Fig. 3b
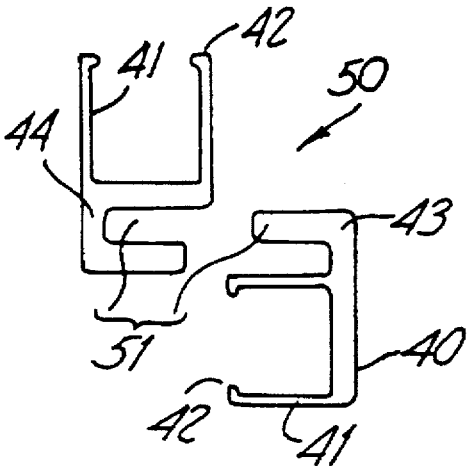
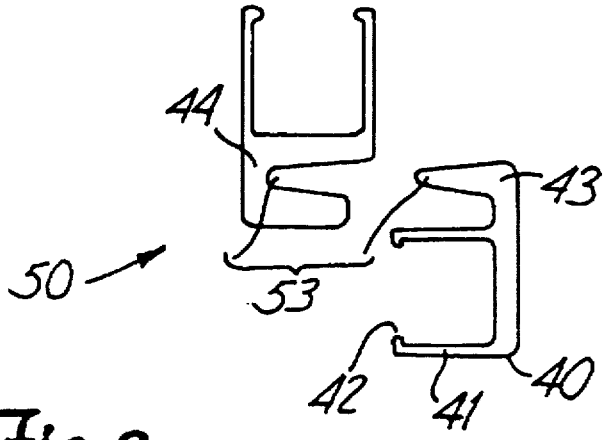
Fig. 3c

Fig. 5a
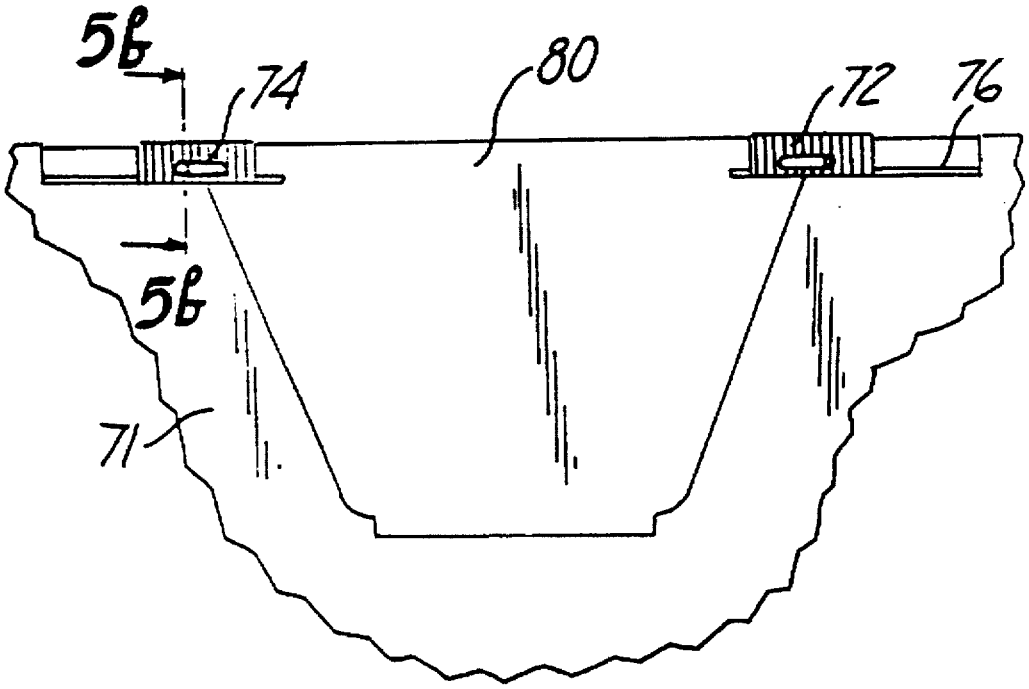
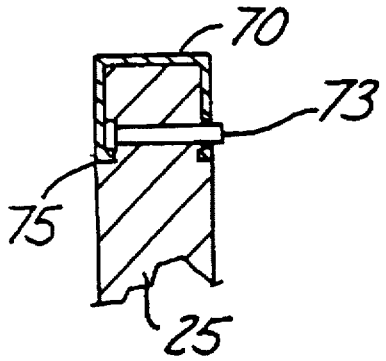
Fig. 5b

TRANSPORT CHAMBER

This is a continuation of application Ser. No. 08/372,192, filed Jan. 13, 1995, now U.S. Pat. No. 5,601,202, which is a continuation-in-part of application Ser. No. 08/178,189 filed Jan. 6, 1994, now U.S. Pat. No. 5,558,241.

BACKGROUND OF THE INVENTION

This invention relates to transport containers or chambers, and in particular to pallet sized transport containers. Transport chambers or containers are used to transport goods, such as food and other products from one location to another for distribution. Typical rigid pallet-sized transport containers are bulky and take up a lot of space. This is not a concern when the containers are filled, however, when they are empty, often times empty containers take up the same space as filled containers and accordingly it is expensive to transport the empty containers. Some containers are known that may be disassembled after unloaded. However, it is important to keep track of the disassembled pieces so that they are not lost or misplaced. Also it is desirable that a transport container be designed so that it may be easily loaded and unloaded.

Thermal transport containers may be used to transport temperature sensitive foods and pharmaceutical products from one location to another. These containers must have thermal barrier characteristics to insulate the enclosed air of the inner cavity of the container from ambient conditions. It is important that thermal transport containers have reliable thermal characteristics. Thermal containers are typically more expensive and it is important that these containers be built for longevity and wear.

SUMMARY OF THE INVENTION

The present invention relates to a transport container including a base and a plurality of side walls perpendicularly connected to form a box-like structure having an inner cavity for storing goods. The side walls of the container are formed of first or upper and second or lower wall panels which are hingedly connected to allow the first or upper wall panels to fold down relative to the second or lower wall panels to collapse the transport container after use. Means for selectively connecting and disconnecting adjacent first or upper wall panels is included to connect adjacent first or upper wall panels for use and to allow the first wall panels to collapse for storage or transport.

The first and second wall panels are hingedly connected by an elongated flexible hinge. Preferably, the flexible hinge is formed of an elastomer material and includes an elongated flexible portion having a plurality of fold over segments to form a wave-like pattern. Preferably as well, the flexible hinge includes contact extensions at opposed ends of the elongated flexible portion for attachment to the first and second wall panels.

Additionally, the second or lower panels are preferably slidably supported relative to the base to allow the second or lower panels to be selectively removed for access to the inner cavity of the container when adjacent first or upper wall panels are disconnected.

BRIEF DESCRIPTION OF THE DRAWINGS

FIG. 1 also shows the location of additional detail views of edge lock couplings and slidelatches;

FIG. 3 shows examples of several embodiments of tang and yoke elements of the edgeloks. Symmetric posilatch features are shown in FIG. 3(*b*) while asymmetric posilatch features, including a tapered tang and a tang with projection on one side are shown in FIGS. 3(*c*) and 3(*a*) respectively;

FIG. 4(*a*) shows a 90° pliolink coupling between the superbase and the sidewall in erected (left) and knockdown orientations (right). FIG. 4(*b*) shows erected (left) and pivoted (right) positions of an 180° pliolink coupling between a gate and a cutout zone of the sidewall;

FIG. 5(*a*) shows a front view of a pair of slidechannel latches to secure gate sections in the erected position; FIG. 5(*b*) shows a sectional view of the side latch taken through the retainer pin; the relationship of the pin extension and the retention slot is evident. This section also shows the flanges of the slidelatch engaged into formed grooves in the gate and cutout zone;

DETAILED DESCRIPTION OF THE PREFERRED EMBODIMENTS

As can be seen from FIGS. 1 through 7, the insulated, knockdown container of this invention includes the following elements.

Figure 1:
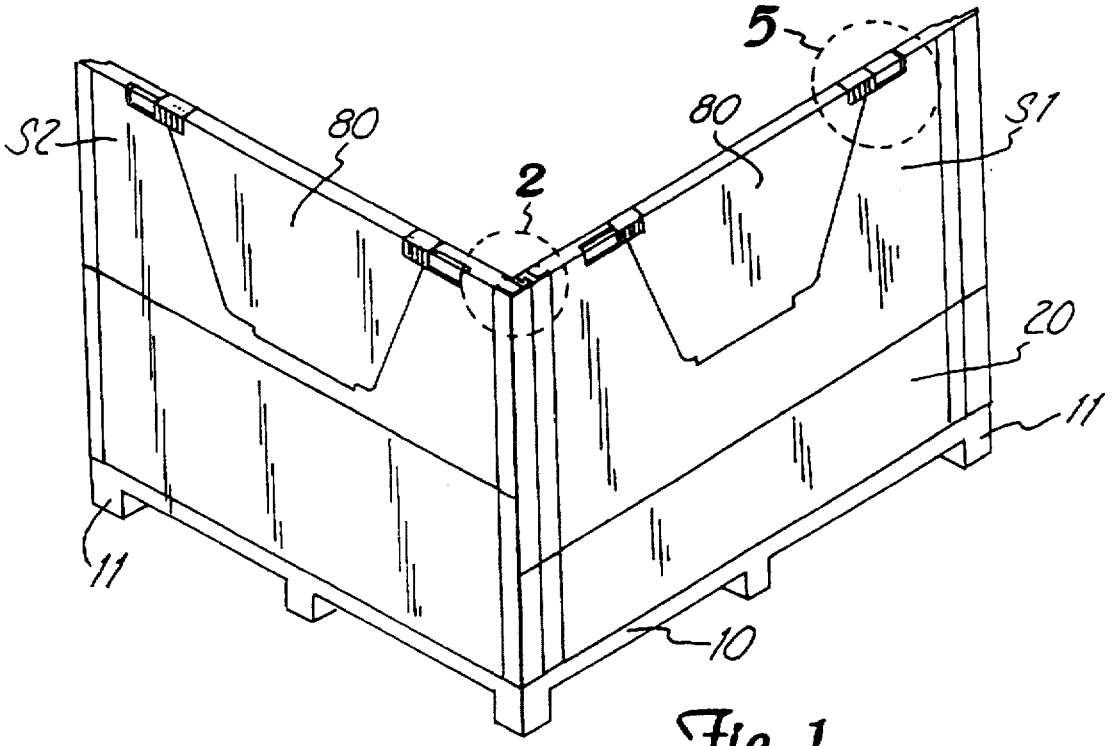
FIG. 1 shows an isometric view of abutting, pivotable sidewalls fitted with load-transfer edgelok couplings, i.e., tangs on one panel which interdigitate with matching yokes on the other. This figure also indicates relative size and placement of sidewall gates to facilitate easy manual loading and unloading.
Figure 2:
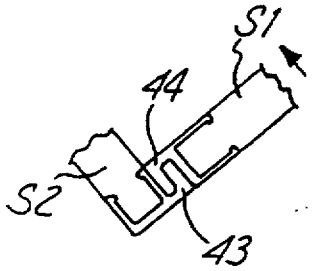
FIG. 2 shows a sectional partial view of interlocking, load-transfer features of the tang and yoke components of a typical edgelok coupling.
Figure 7:
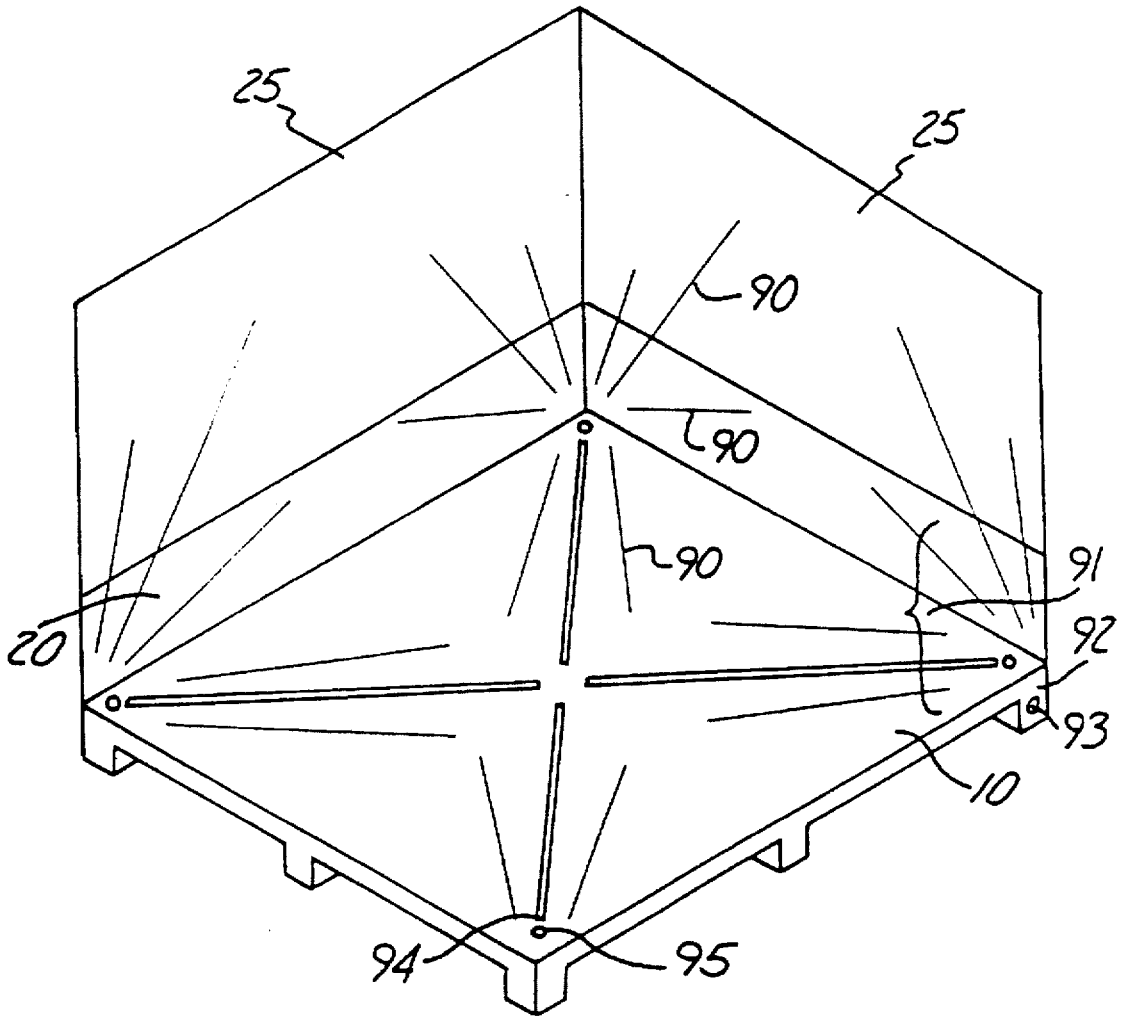
FIG. 7 shows a partial isometric view of the inside of a chamber with two walls in the erected position. From this perspective, the orientation and interconnection of dewchannels of the sidewalls and super walls into a function array is clearly seen. The orientation of base dewchannels to drain condensate toward the corner pockets can be easily visualized.

Base 10 (FIGS. 1 and 7). A rectangular component with a thermally insulated upper face adapted to drain a puddle of liquid from its center toward the nearest corner and into a drainable pocket reservoir, fitted with downward-facing bottom standoff elements at each corner to allow passage of the forks of a lifting device under the base and edge-engagement socket features along two lateral and two transverse edges.

Figure 6:
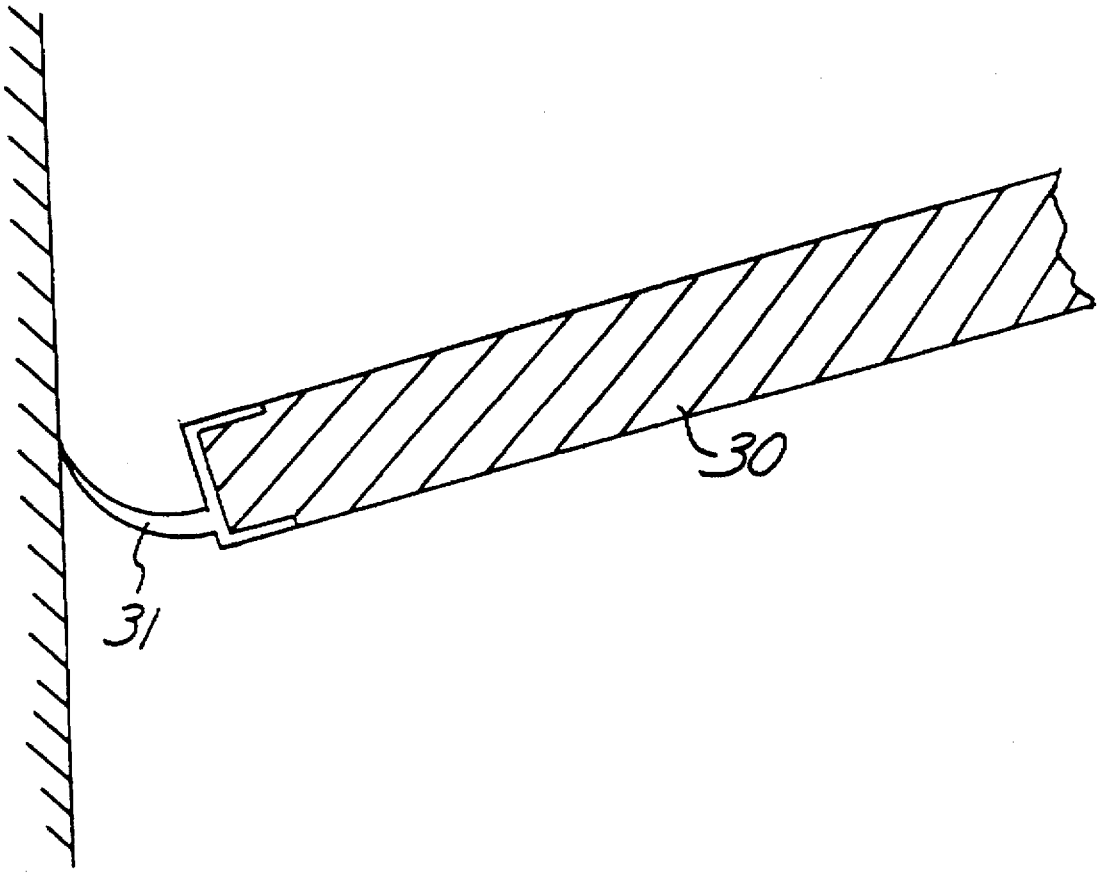
FIG. 6 shows a sectional partial view of the cover and compliant sealwings for an insulated container partially loaded with cold product. The sealwings are long enough to permit tilting the cover as it brought into contact with contents which do not completely fill the chamber. As can be seen, the tapered elastomer sealwings extend 20 to 50 mm beyond the edge of the cover and are preformed with an upward curve in their tip zone.

Superbase 20. A set of short, insulated vertical superwall elements including two transverse and two lateral elements, all oriented substantially perpendicular to the upper face of the base and coupled rigidly together at their abutting vertical edges, all their bottom edges having minor image projection features adapted to engage with socket features of the base;

Sidewalls 25. A set of pivotable, insulated wall elements including two transverse and two lateral sidewalls, S1 and S2, respectively, all oriented substantially perpendicular to the upper face of the base when erected, coupled rigidly together at their abutting vertical edges, in the erected position, by edgelok couplings, sized to permit first opposing pair to pivot inward toward each other over an angle of 90° inside the other pair still in the erected orientation, second opposing pair also pivotable inward toward each other over an angle of 90° after the first pair is already in the knockdown position, supported and guided in pivoting movements from the erected position to the knockdown position by pliolink plicated couplings; and Cover 30 (FIG. 6). A removable flexible insulating structure sized for a tight-fitting vapor seal inside the lateral and transverse sidewalls at any vertical position above the superbase for the purpose of preventing heat transfer to the contents by radiation, conduction, convection and inspiration of air from the environment, which can be frictionally secured in contact with the contents at any level within the height of the sidewalls.

Sealwings 31 (FIG. 6). Compliant, curved elastomer sealwings extending from the cover edges make a positive gas seal between the cover and the inner surfaces of the sidewalls. The specific tapered form, length, thickness and physical properties of the seal wings causes them to emit a distinctive sound as the cover is pushed downward from the top of the sidewalls until it is in light contact with the contents. This acoustic feature is related to the remnant frequency of the sealwing flaps as Strouhal vortices are shed from their training edges due to jets of air being expelled from the enclosed load cavity of the container. The pitch of the unique "whooshing" sound is of significant value to confirm that all the other seals of the container are tight, that air is in fact being expelled in response to displacing the cover downward toward the contents and that all of the sealwings are in a dependable sealing relationship with the inner surfaces of the sidewalls.

Edgelok 40 (FIG. 2) couplings of this invention serve to transfer hoop stresses between abutting, pivoting sidewalls of a container. Typically, edgeloks are formed from thermoplastics by extrusion-type processes and are attached along the entire length of all abutting sidewall edges. Edgelok pairs transfer loads and forces by means of mating yoke and tang features which come into an intertwined relationship when both adjacent panels are pivoted into their erected positions. To provide a secure lock to hold the sidewalls in their intertwined relationship, symmetric or asymmetric mating posilatch features are incorporated on selected faces of the tang and yoke.

Edgeloks are formed with a channel-type engagement feature 41 for attachment to the adjacent edges of the sidewalls; typically the engagement channel also contains attachment flanges 42 which mate with preformed grooves in the sidewalls and provide additional mechanical load transfer between the panel and the edgelok. Typically, the edgelok channel is a light interference fit with the mating, prepared vertical edges of the pivoting sidewalls and full-length edgeloks can be slid manually into position. Adhesives, conventional fasteners (e.g., pop rivets, screws, etc.) as well as bonding/welding methods can be used to provide additional strength and stiffness in the joint between the sidewall edge and the edgelok.

Posilatch elements 50 (FIG. 3) function to maintain the erected sidewalls in full engagement while the chamber or container is being loaded or unloaded, i.e., to prevent accidental disengagement and spilling of the contents. A further benefit of the posilatch is to maintain the fully engaged position of the tang and yoke under vibration, twisting and tilting during handling of a loaded container. The most significant benefit of the posilatch is to provide additional sealing against inspired air being drawn or pumped into the insulated space by "oil-canning" of the sidewalls during handling. Posilatch elements may be either symmetric or asymmetric with respect to the plane of intertwinement of the tang and yoke. The symmetric configuration 51 shown in FIG. 3(*b*) has greater seal area and is preferred for containers for heavy, cold loads. Asymmetric posilatch elements 52 shown in FIGS. 3(*a*) and 3(*c*) which are positioned at the zone of maximum compression between the tang and yoke, increase in engagement directly with increases in the force loading on the edgelok.

Pliolinks 60 (FIG. 4) are plicated elastomer couplings which serve to guide and control pivoting motions of sidewalls and gates 80 of knockdown containers of this invention. Pliolinks are elongated strips of serpentine-pleated elastomer 61 adapted for attachment to edges of pivoting, insulated sidewall or gate panels. The typical thickness range of sidewall panels is 20–80 mm. The width, elastomer stiffness, and pleat compliance of the specific pliolink are balanced to prevent tensile overstress and permanent deformation-set of the elastomer strip during container storage for an extended period at room temperature in the knockdown position, i.e., pivoted 90° from the erected position.

For 90° pivoting of sidewalls, the pliolink strip is attached to preformed step zones 26 of the superbase and the abutting sidewall. The entire width of the pliolink strip may be reinforced by encapsulating a centered fabric layer i.e., woven, knit, or non-woven fibers such as amide, imide, carbon, etc. The two lateral edges of the pliolink strip 63 may be buttressed with stiffening channels, strips or plates to prevent stress concentration at points where the edges are secured to the panels by fasteners such as screws or rivets. Alternately, the edges of the pliolink strip may be formed into a unique T-shaped rib which snaps with tight interference into a mating groove formed in the edges of the parts to be coupled for pivotal movement. For additional strength, the T-rib embodiment lends itself to use of a liquid adhesive for permanent bonding of the pliolink into the pivotal elements. Sinewave-type pleats in the pliolink are formed by molding in conventional elastomers such as neoprene or by extrusion for TPE elastomers. For typical sidewalls, the undulating sine pleats of the pliolink are extruded form basic TPE material such as Kraton (tm 1–5 mm thick), having a period in the range 5–20 mm and a peak-to-peak height of 8–20 mm.

Slidelatches (FIG. 5) are pairs of slidable channel elements which interconnect the top edge portion of a pivoting gate with the top edges of adjacent cutaway openings 71. With both slidelatches in their first latched position, 72, the gate is secured across the opening; with both slidelatches in their second retracted position, the gate can be pivoted up to 180° inward into the container. Channel-like slidelatch elements are movable to and fro over a distance of 1–2 panel thicknesses and are retained laterally by a through pin 73 which extends from the sidewall and engages an elongated slot 74 in the slidelatch. Slidelatches are retained against pivotal movement by an edge flange 75 which extends into a mating groove in the gate 76 and cutaway opening. The sidewalls of the channel of the slidelatch are thick enough to support low levels of externally-applied inward force and load as might occur during handling or transit. The gate and cutaway are prepared with mating conical alignment pegs/sockets to assure that forces and loads arising from shifting of the contents are supported by the broad mating flanges of the gate and the cutaway opening. For a loaded container, the interdigitated pegs/sockets support distortional loads upon the sidewalls, and the purpose of the slidelatches is to maintain full engagement of the pegs with the sockets. Slidelatches may be prepared by extrusion of metals, alloys or polymers to the desired flanged-channel profile. Alternatively, they may be formed from alloys or polymers by rolling or drawing methods.

Dewchannels 90 (FIG. 7) are drainage flow paths formed integral with the inner surfaces of the sidewalls, superbase and base upper face. During loading an erected container with cold products, when the cover is removed and the inner surfaces of the sidewalls, superbase and base are fully exposed to humid air, liquid condensate "dew" will form on all the cold surfaces that are below the air dew point. Typical paperboard packages for food or pharmaceuticals in contact with these surfaces will be wetted by dew and resulting capillary flows will transfer contaminants from the container surfaces and the environment into and onto the product. Frozen products, such as ice cream cartons in contact with the top face of the base, are particularly sensitive to contamination by accumulations of dew which form "puddles" on the base. An interconnected array of dewchannels 91 according to this invention provides a set capillary channels to purge surface dew from the base, superbase and sidewalls and draw the liquid residue into drainable pockets 92 below the four corners of the base. To allow continuous release of collected liquid dew from the base pockets, each pocket is fired with a check valve 93 which assures egress of liquid and prevents entry of environmental liquids as might result from standing water on a loading dock exposed to rain.

The cover 30 (FIG. 6) is a tight-fitting, insulated panel which prevents heat exchange and air inspiration between the contents and the environment. The edges of the cover are fired with sealwings 31 which form a positive gas seal for the top of the enclosed load space. Sealwings are compliant, curved elastomer flaps which extend from the edges of the cover and are slightly deflected when they come into contact with the inner surfaces of the sidewalls.

EXAMPLES OF ALTERNATIVE EMBODIMENTS

Example 1

Alternative Forms, Sizes, Application Fields

The knockdown insulated carriers of this invention can be prepared in a wide variety of sizes for many diverse purposes. A container with a two or four-wheeled base, in the general form of a hand truck, would be useful in a hospital or restaurant. In certain cases, snap-on type removable wheels and axles could be fitted to the container after it is unloaded from the transport trailer. A carrier with a manual lift bale or lift eye for engagement with a wheeled machine would be useful for galleys in a train or airliner. Likewise, a unique form container shaped to nest into the hull contours of the loadbay of an aircraft would be useful for air shipments of perishable goods such as bulk seafood or pharmaceutical fluids. Indeed, the knockdown insulated containers of this invention would be of significant value for transport of food and medical supplied to a war zone or natural disaster.

One major embodiment is in the form of pallet-type containers designed to be handled with a wheeled manual jack (one high) or a powered forklift (stacked two-high). Table 1 gives typical dimensional range

TABLE 1

Typical Size Ranges, Pallet-Style Containers

| Feature | Parameter(s) | Size Range, S1 Units |
|---|---|---|
| S1, S2 Sidewalls | Length | 0.8 < meters < 1.5 |
| | Height | 0.2 < meters < 1 |
| | Thickness | 20 < mm < 80 |
| Superbase Walls | Length | 0.8 < meters < 1.5 |
| | Height | 60 < mm < 300 |
| | Thickness | 20 < mm < 100 |
| Base | Length | 0.8 < meters < 1.5 |
| | Width | 0.8 < meters < 1.5 |
| | Height | 130 < mm < 230 |
| | Max. Fort Ht. | 80 < mm < 150 |

TABLE 2

Typical Materials for Pallet-Type Containers

| Feature | Element | Material | Process | Structural Details |
|---|---|---|---|---|
| S1, S2 Panels | Skin | Polyolefin, PE | Blowmolded | 0.4 < mm < 2.2 wall thickness |
| | insulation | Urethane Foam | Injected | 0.1 mm diam. pores, 20 < mm < 150 thick |
| Superbase | Skin | Polyolefin, PE | Blowmolded | 0.4 < mm < 2.2 wall thickness |
| | insulation | Urethane Foam | Injected | 0.1 mm diam. pores. 20 < mm < 150 thick |
| Base | Frame | Polyolefin, PE, PP | Injected | 4 < mm < 12 section thickness |
| | Insulation | Urethane Foam | Attached | 0.1 mm diam. pores. 20 < mm < 70 thick. deck |
| Cover | Sheath | Film, Fabric, Nonwoven | Formed | Surf, coating w. crease lines/zones |
| | Core | closed-cell Foam | Cut sheet | foldable, segments, strips |
| | Sealwing | elastomer | Formed | compliant, compressible shaped strips 3 < mm < 15, tapered fin edge extension |

TABLE 3

Typical Yoke and Tang Load Couplings

| Feature | Material | Parameter | Characteristic |
|---|---|---|---|
| Tang | Polyolefin, PE, PP | (Thickness of section | 6 < mm < 12 |
| | ABS | at maximum load | 5 < mm < 10 |
| | Polyamide, Nylon 66 | stress) | 5 < mm < 10 |
| | Polycarbonate | | 5 < mm < 10 |
| Yoke | Polyolefin, PE, PP | (Thickness of section | 6 < mm < 12 |
| | ABS | at maximum load | 5 < mm < 10 |
| | Polyamide, nylon 66 | stress) | 5 < mm < 10 |
| | Polycarbonate | | 5 < mm < 10 |

values for pallet-type containers. For two-high stacking in truck transport, an alternative base configuration with edge-alignment features and wide edge flanges for spreading the compression load would be needed for loads of more than 300 kg in the upper unit.

Example 2

Alternative Materials for Base, Panels, Edgelok, Couplings, Insulation, Plicated Elements, and Slidelatches Table 2 lists a range of typical alternative materials, processes and structural details for typical pallet-type insulated containers. These materials and section-thickness values are also valid for light and medium duty containers with minimal insulation values. For heavy-load containers, the base, superbase, and wall panels must be prepared from thicker-gauge, high-strength polymers and the injected foam/method must be chosen for strength and impact resistance of the resulting structure rather than thermal conductivity.

Typically, large, flat, rectangular wall panels for superbase and S1, S2 sides up to 75 mm thick are made by blowmolding processes with a wide variety of thermoplastics; other processes such as vacuum forming and compression molding could also be used for thinner, smaller panels and special structures/shapes. By compensating the thickness and size of the parison, the final wall thickness of the blowmolded shells are adjustable over a relatively wide range, i.e., 0.5–5 mm.

Extrusion-type processes are used to form the special-shape sections for the yoke and tang elements of the edgeloks and the slidechannel latches. A wide variety of thermoplastics is used for these sections depending upon strength, cost, and bonding/fastening considerations for assembly. For increased column stiffness to support loading insulated containers 2-high, the edgelok are prepared with heavier wall sections and deeper channels for engaging the sidewall edges. Thermoplastics with maximal strength and impact toughness are used for containers to transport heavy items or 3-high stacking. Because of the shape and light loading, slidechannel latches can be extruded from any convenient thermoplastic; transparent or special colors/patterns are used to provide a visible indication that the latches are fully engaged.

Plicated couplings between the pivoting panels are molded to the desired serpentine shape using standard elastomers such as SBR, U, FPM, CR, etc. (all ASTM-designations); for maximum tear resistance, fabric reinforcement is also used. TPE compositions is directly extruded to the desired serpentine form as needed for gates and sidewalls.

Sealwing elements are made of synthetic elastomers such as polysiloxane, TPE, polyurethane, etc. Their curved-tip form, 10<radius of curvature, mm<100, and tapered thickness from base to tip, 5<thickness, mm<0.05, allows the use of many alternative molding or extrusion processes.

Example 3

Loading of Edgeloks, Posilatches and Resulting Stresses

Table 3 discloses typical materials, shape and dimensional ranges for the edgelok and posilatches, especially the yoke and tang features for a pallet-type embodiment of the insulated chamber of this invention.

Posilatches are mating engagement protrusions on the tang and yoke which require a positive elastic deflection of the yoke and tang. The shape of the camming surfaces, the amount of deflection required to reach full engagement and the amount of residual spring force applied between the yoke and tang at full engagement are all important design factors. For long life and minimal wear between the camming surfaces, the maximum yoke stress during engagement should not exceed about 50 percent of the rupture strength and the long-term residual stress at full engagement should not exceed about 10 percent of the rupture strength. For typical pallet-type containers with wall thickness in the range of 30–45 mm; the yoke deflection during and after engagement are 0.5–0.8 mm and 0.05–0.2 mm; respectively.

For a pallet-type container, the sidewalls are a composite of a thick center layer of insulating foam, 30–50 mm thick, covered on both sides by a tough, blowmolded skin, 1–3 mm thick. Sidewall strength in simple flexure is sensitive to the thickness of the blowmolded skin and the shear strength of the foam-skin interface. Assuming the container is loaded with a reinforced bladder filled with liquid such as culture media, the outside faces of the sidewalls will be loaded in tension. One "soft landing" failure mode for avoiding overloading of the container would be to have the sidewalls bow elastically enough to be visually detected well before the bladder is filled with liquid. Addition of stiffening ribs which extend generally in a lateral or circumferential direction formed into the skin of the outer face of the sidewalls is an effective way of increasing their stiffness toward loads exerted by container contents. Optimally, such external reinforcing ribs would be larger and or more closely spaced toward the top of the sidewalls.

Example 4

Thermal Characteristics of Edgeloks and Sidewalls

Equivalent thermal conductivity of the composite superwall and sidewall panels for typical pallet-type applications should fall in the range of 0.02–0.04 W/m-deg. Major thermal shunt paths, such as "kiss zones" of the blowmolded sidewall skin layers where the insulation thickness is zero, must be eliminated or kept to a minimum. In order to achieve over all maximum thermal isolation for the chamber, the insulation injection process can be done in two or more stages m place material with the lowest thermal conductivity at the thinnest insulation zones or at locations of maximum heat flux by all mechanism combined.

For maximal thermal isolation of the contents in a hot, humid environment, the external surfaces of the base, cover, sidewalls, and superwalls should have a laminated film or coating of IR-reflective material, such as a thin film of aluminum, to reduce radiation heat transfer to a minimum.

Example 5

Dewchannel Characteristics and Properties

Dewchannels. Drain paths formed integral with the inside surfaces of sidewalls, superwalls, and base provide a preferred channel to direct the flow of wall condensate away from the container contents and thus prevent contamination. A drop of liquid formed anywhere on the inner surfaces of the insulated container of this invention will be directed along a set of interconnected capillary channels, dewchannels, and into a drainable reservoir pocket formed integral with the base. The dewchannels in the vertical inner faces are formed in fan-like array pointing toward the nearest corner pocket. Dewchannels are formed into the blowmolded inner surface as a narrow capillary slot, 0.1–0.3 mm wide, approximately 24 mm deep and the channels are selectively prepared or treated to become hydrophilic, i.e. easily wettable by water. Base dewchannels, which do not depend upon capillary wetting for flow direction control, can be valleys formed between a fan-like array of ridges extending upward form the top surface of the base and directed generally from the center of the base area and toward a focus at the corners to connect with vertical channels to direct flow downward and into the pockets. Base dewchannels are typically about 3–5 mm wide, 3–10 mm deep and are separated by lands at least 100 mm wide. By positioning the insulated cover at a slight angle, dew collected on its inner surface will be directed to the lowest corners. To allow for extended storage, the volume of each of the 4 base drain pockets should be about 1 liter.

Known plasma treatment methods can be used to prepare local hydrophilic surface areas of polymers, i.e., having good wettability by water.

Figure 8:
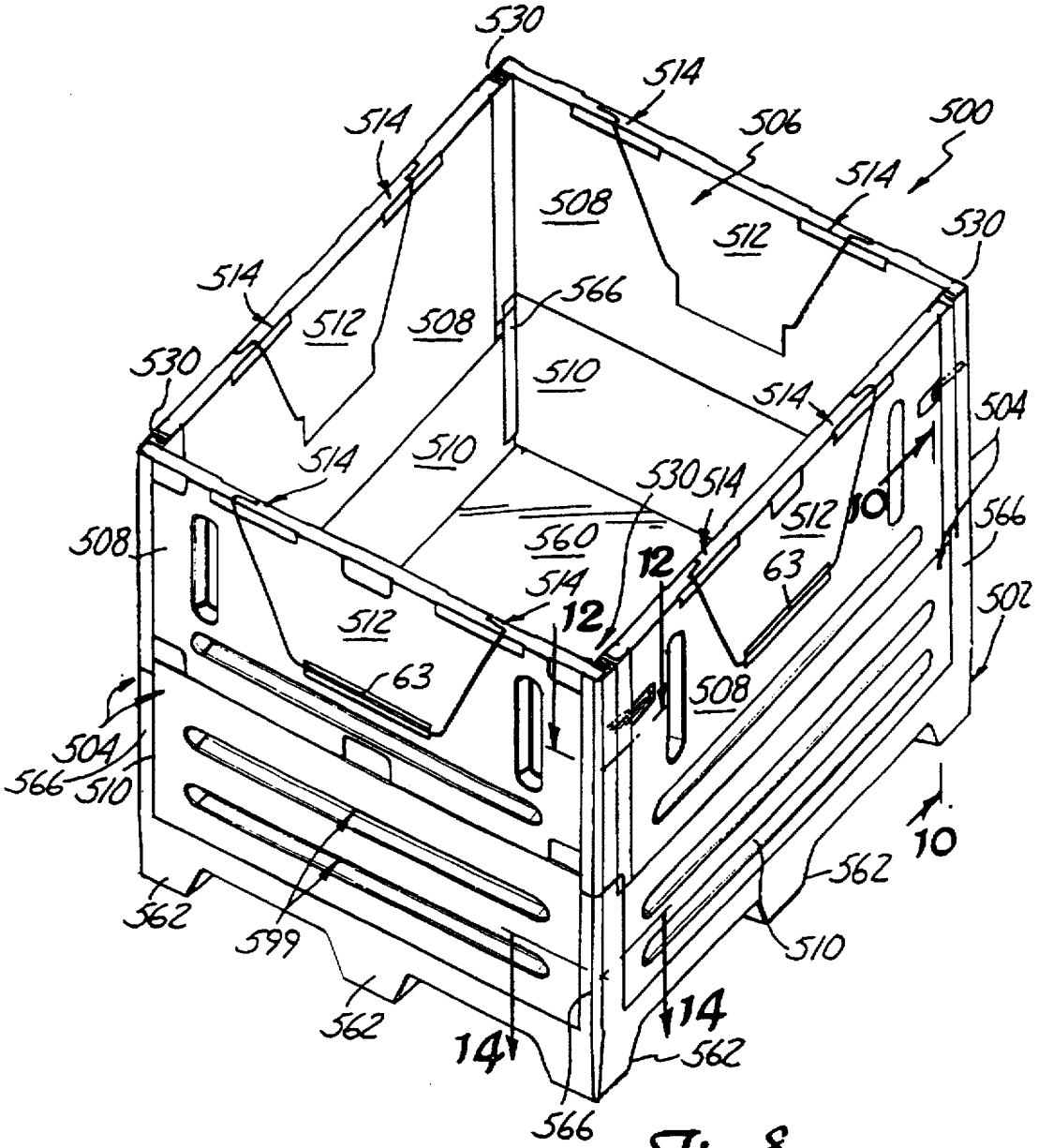
FIG. 8 is a perspective view of an alternate embodiment of a container.
Figure 9:
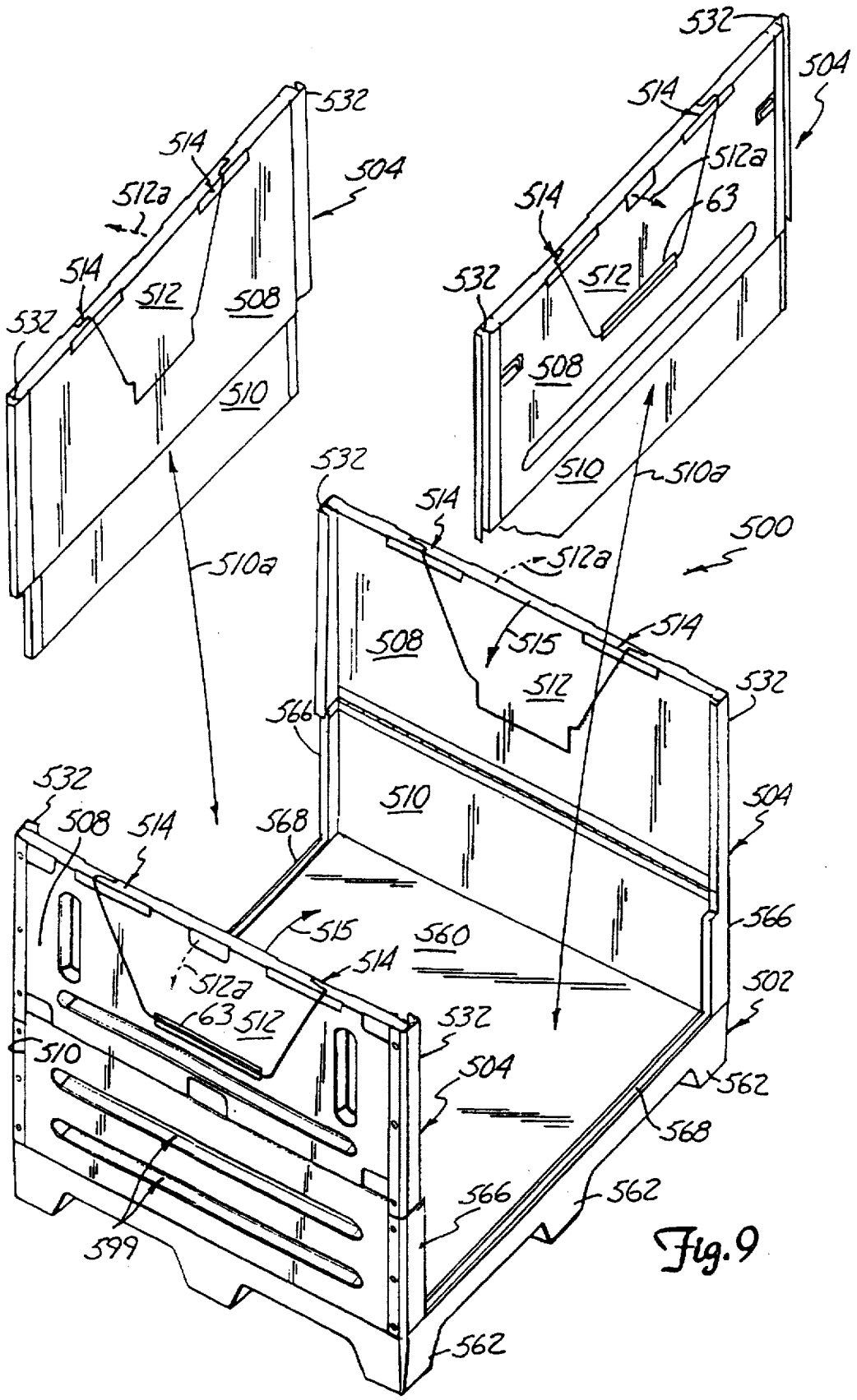
FIG. 9 is a perspective view of the container of FIG. 8 illustrating the side walls slidably withdrawn.

FIGS. 8–13 show an alternate embodiment of a transport container 500. As shown in FIGS. 8 & 9, the transport container 500 includes a base 502 and four side walls 504. The side walls 504 are perpendicularly aligned relative to one another and extend perpendicularly from the base 502 to form a box like structure defining an inner cavity 506 for storing goods.

Figure 4A:
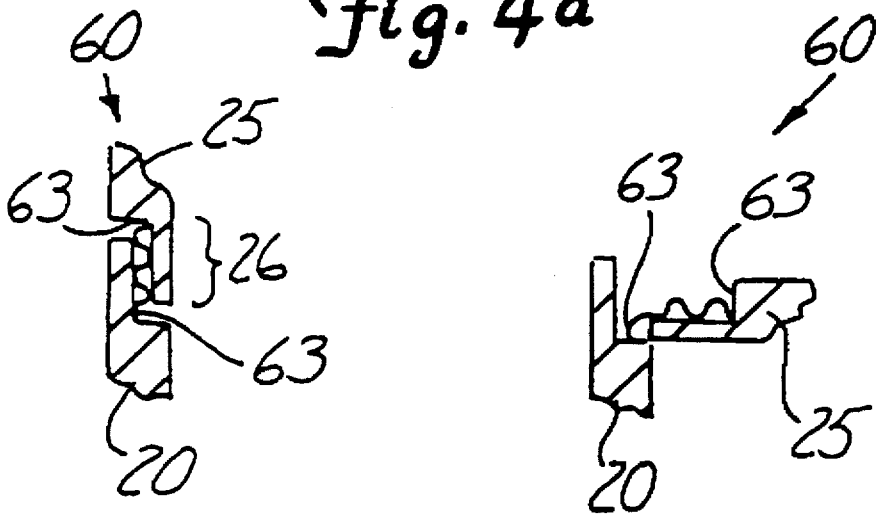
FIG. 4 shows sectional view of alternative 90° and 180° pliolink couplings.
Figure 4B:
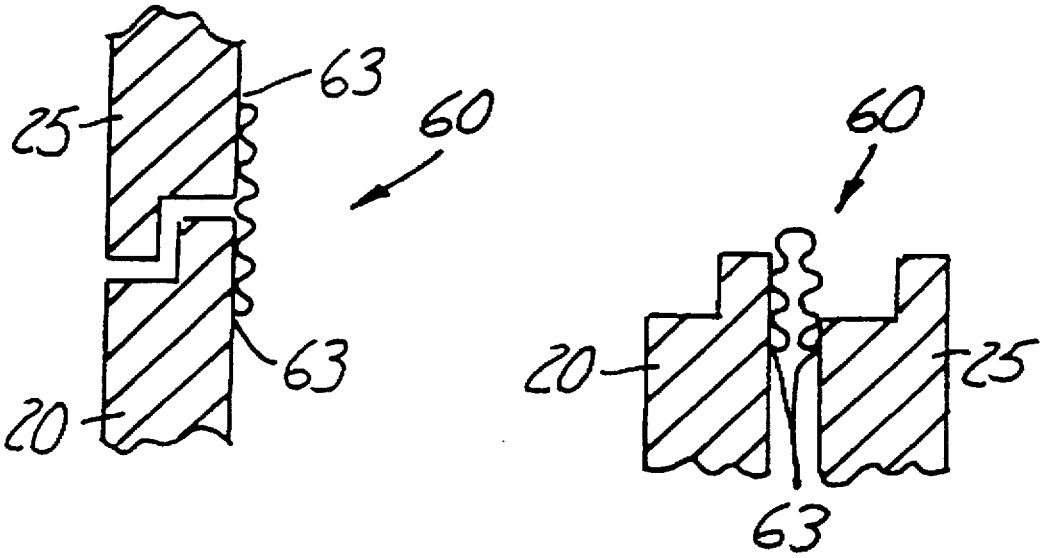

Side walls 504 include first (upper) and second (lower) wall panels 508 and 510 and gate 512. The gate 512 is hingedly connected to the first wall panel 508 so that the gate 512 may be selectively opened and closed (as indicated by arrow 512*a* of FIG. 9) to access goods during transport. Preferably, gate 512 is hingedly connected to the first wall panel 508 by an elongated flexible hinge 63 as shown in FIGS. 4*a* and 4*b*. A latching assembly 514, similar to that shown in FIGS. 5*a* and 5*b*, may be used to selectively lock and unlock the gate 512 relative to the first wall panel 508.

Figures 10, 11:
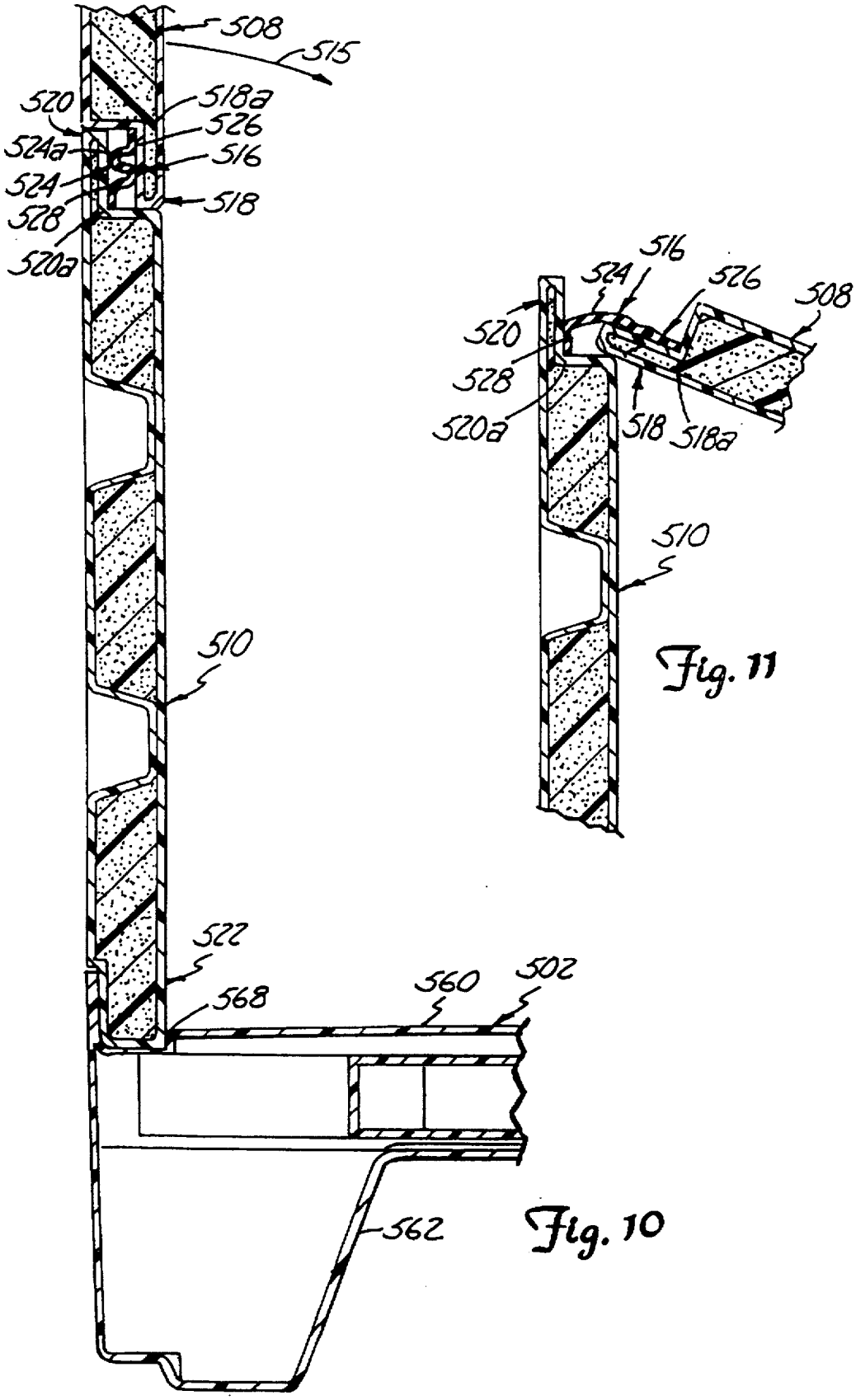
FIG. 10 is a sectional view taken along line 10—10 of FIG. 8.
FIG. 11 is a sectional view similar to FIG. 10 illustrating the first or upper wall panel folded down.

As shown in FIGS. 9–11, the first and second wall panels 508 and 510 are hingedly connected to pivot between a use position and a storage position, as indicated by arrow 515 of FIGS. 9 & 10. The first wall panels 508 pivot relative to the second wall panels 510 to fold down to the storage position as illustrated in FIG. 11. The second wall panels 510 are slidably supported relative to the base 502 so that separate first and second wall panels 508 and 510 may be removed for access to the inner cavity 506 for loading and unloading. The first and second wall panels 508 and 510 may be slidably removed as indicated by arrow 510*a* of FIG. 9.

As shown in FIGS. 10 & 11, the first and second wall panels 508 and 510 are hingedly connected by an elongated flexible hinge 516. The first wall panel 508 includes a stepped hinge flange 518. The second wall panel 510 includes a stepped hinge flange 520 and support flange 522. The stepped hinge flange 518 of the first wall panel 508 and the stepped hinge flange 520 of the second wall panel 510 are cooperatively aligned to mate to form a stepped connection.

The elongated flexible hinge 516 (or pliolinks) includes an elongated flexible portion 524, and contact extensions 526 and 528. The contact extensions 526 and 528 are at opposed ends of the elongated flexible portion 524. The contact extensions 526 and 528 are relatively flat portions for connecting opposed ends of the flexible hinge 516 to the hinge flanges 518 and 520 of the first and second panels 508 and 510, respectively. The contact extensions 526 and 528 are connected to the corners 518*a* and 520*a* of the stepped hinge flanges 518 and 520. The contact extension 526 and 528 are connected to the corners 518*a* and 520*a* by a suitable mechanical fastener.

The elongated flexible portion 524 is formed of a plurality of fold over segments 524*a* to form a wave-like pattern. Preferably, the elongated flexible portion 524 includes between 3 to 7 fold over segments 524*a*. The fold over segments 524*a* of the hinge 516 serve to enhance the hinging characteristics of the flexible hinge 516 and provide a seal between the inner cavity 506 of the container 500 and the ambient air for a thermal transport container.

Figure 12:
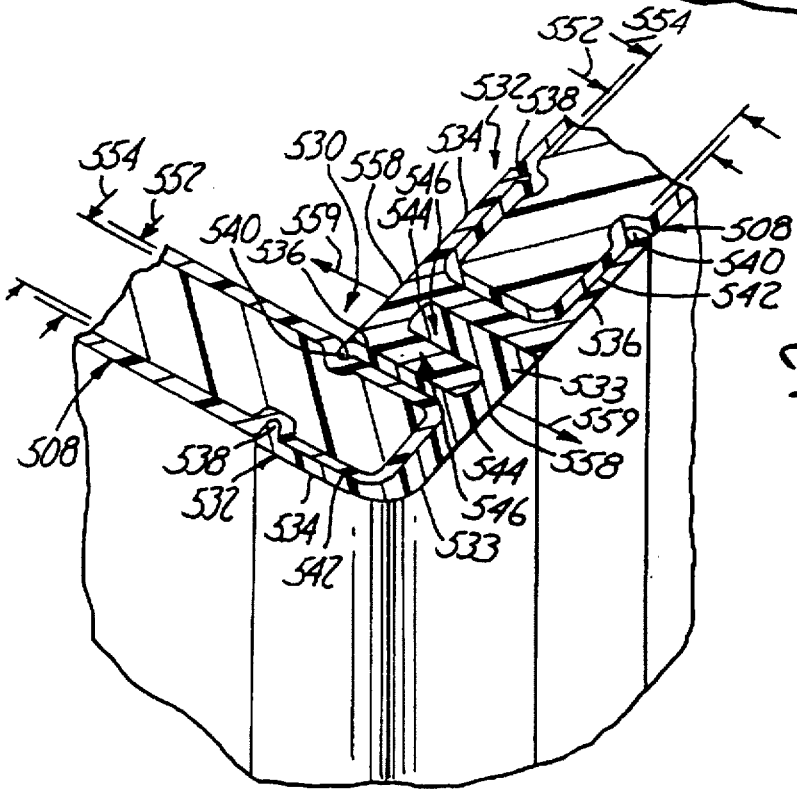
FIG. 12 is a sectional view taken along line 12—12 of FIG. 8.

Adjacent first wall panels 508 are selectively locked in the use position by an edgelok coupling assembly 530 as shown in detail in FIG. 12. The edgelok coupling assembly 530 includes cooperating edgeloks 532. The edgeloks 532 include base 533, legs 534 and 536, attachment flanges 538 and 540, wall channel 542, latch channel 544 and latch extension 546.

Leg 534 and 536 extend from the base 533 in spaced opposed relation to form a U-shaped member forming the wall channel 542. The attachment flanges 538 and 540 extend perpendicularly from legs 534 and 536, respectively. The base 533, legs 534 and 536, wall channel 542 and attachment flanges 538 and 540 form the wall attachment portion of the edgeloks 532.

The wall attachment portion of edgeloks 532 is attached to the first wall panels 508. The first wall panels 508 have opposed edge portions. The edge portions includes a first width portion 552 and a smaller second width portion 554. The legs 534 and 536 are spaced to define a wall channel 542 that is similarly sized to the first width portions 552 of the first wall panels 508 In particular, the legs 534 and 536 are spaced to frictionally engage the first width portion 552 of the first wall panels 508. The second width portions 554 are sized smaller than the first width portions 552 to accommodate the attachment flanges 538 and 540. The wall attachment portions of the edgeloks 532 slide onto the edge portions of the first wall panels 508 and attach the edgeloks 532 to the first wall panels 508. The edgeloks 532 may be permanently attached to the first wall panels 508 by conventional mechanical fasteners. The attachment flanges 538 and 540 are provided to maintain the connection of the edgeloks 532 to the first wall panels 508 and provide structural integrity.

The latch channels 544 and latch extensions 546 of the edgeloks 532 form the latch portion of the edgelok 532. The latch extension 546 is connected to base 533 by arm 558. The arm 558 extends from the base 533 and the latch extension 546 extends perpendicularly from the arm 558. The extent of the arm 558 defines the latch channel 544 between the base 533 and latch extension 546. The latch channels 544 and latch extensions 546 of edgeloks 532 are oriented so that cooperating edgeloks 532 attach adjacent perpendicularly aligned first wall panels 508 to provide a yoke and tang connection where the latch extension 546 of one edgelok 532 fits into the latch channel 544 of an adjacent edgelok 532 to selectively connect and disconnect adjacent first wall panels 508 as illustrated by arrow 559. Alternate embodiments of an edgelok coupling assembly are shown in FIGS. 3*a* and 3*b*.

Figure 13:
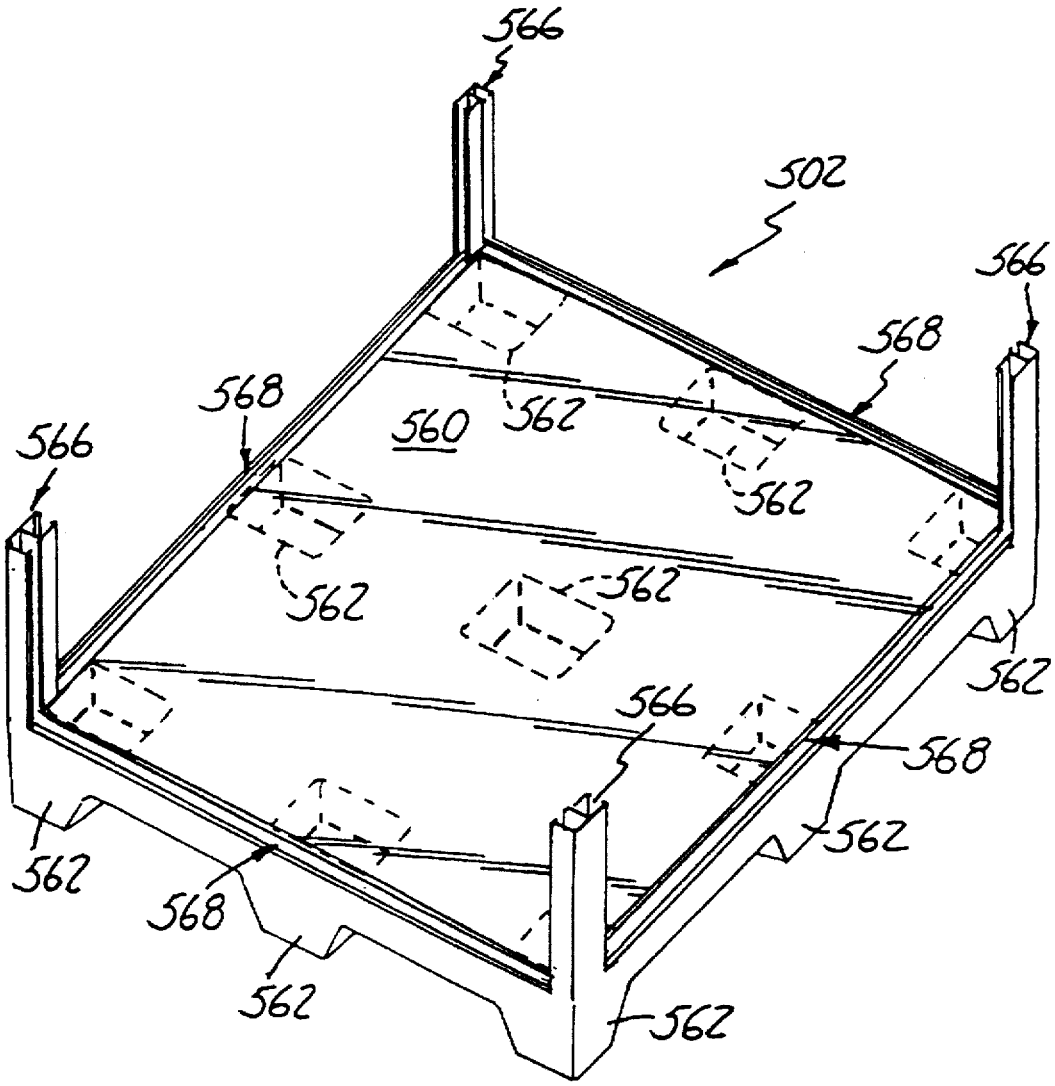
FIG. 13 is a perspective view of the base of the container.

As shown in FIGS. 10 & 13, the base 502 includes a floor 560, legs 562 (or standoff elements), corner attachment assemblies 566 and a base flange channel 568. The legs 562 extend perpendicularly downward from the base 502 to support the base 502 above the ground. The length of the legs 562 is designed to allow a forklift or other machine access to lift and move the container 500. The corner attachment assemblies 566 are fixedly attached to the base 502 and extend perpendicularly therefrom to support adjacent second wall panels 510 to form the superbase. In particular, the corner attachment assemblies 566 are positioned at four corners of the base 502 to provide a frame for slidably supporting the second wall panels 510.

As shown in FIGS. 10 & 13, the base flange channel 568 is sized so that the support flange 522 of the second wall panel 510 frictionally fits therein. Conventional fasteners, such as a nut and bolt, are used to selectively attach the support flange 522 of the second wall panel 510 to the base 502. The floor 560 of the base 502 may be convex or concave shaped to facilitate draining. Preferably the floor 560 of the base 502 is convex and drainage openings are provide at the corners of the base 502 (not shown). Alternatively, if the floor 560 is concave a drainage opening is provided at the center of the base 502 (not shown).

Figure 14:
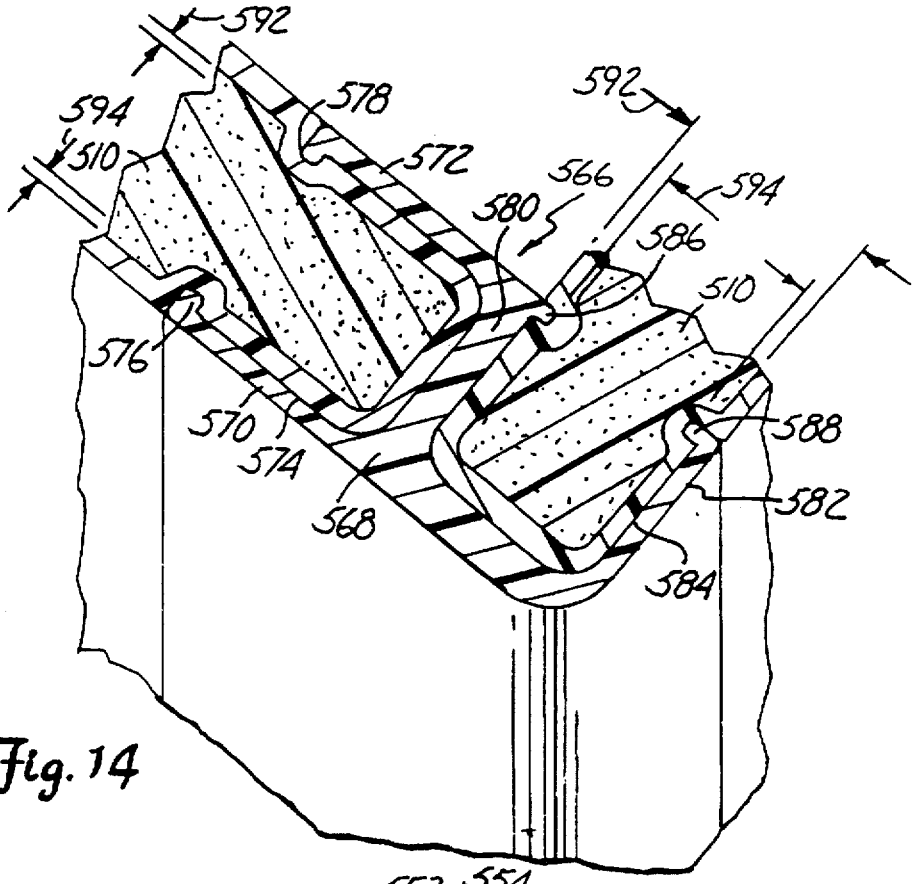
FIG. 14 is a sectional view taken along line 14—14 of FIG. 8.

As shown more clearly in FIG. 14, the corner attachment assemblies 566 includes a base 568, first spaced legs 570 and 572, first wall channel 574, first opposed attachment flanges 576 and 578, second spaced legs 580 and 582, second wall channel 584 and second opposed attachment flanges 586 and 588.

Legs 570 and 572 extend from the base 568 in spaced opposed relation to form a U-shaped member forming the first wall channel 574. Legs 580 and 582 extend from the base 568 in spaced opposed relation to form a U-shaped member forming the second wall channel 584.

The second wall panels 510 have opposed edge portions. The edge portions include first width portions 592 and second smaller width portions 594. The opposed legs 570 and 572 and opposed legs 580 and 582 are spaced to define wall channels 574 and 584, respectively, that are sized to allow the first width portion 592 of the second wall panels 510 to be slidably inserted into the wall channels 574 or 584. Legs 570, 572 and 580, 584 are aligned to perpendicularly connect adjacent second wall panels 510. Preferably, the size of the wall channels 574 and 584 is sufficiently designed to allow for one or all of the second wall panels 510 to be selectively removed from the corner attachment assemblies 566 to facilitate unloading of the container as illustrated in FIG. 9 (arrow 510*a*).

The first attachment flanges 576 and 578 and second attachment flanges 586 and 588 extend perpendicularly from the first opposed legs 570 and 572 and second opposed legs 580 and 582, respectively. The second width portions 594 are sized smaller than the first width portions 592 to accommodate the first attachment flanges 576 and 578 and the second attachment flanges 586 and 588. The attachment flanges 576, 578, 586 and 588 are aligned and spaced to contact the second width portions 594 of the second wall panels 510 to keep the edge portions of the second wall pan from becoming inadvertently disengaged from the corner attachment assemblies 566.

Thus, there has been described a container where adjacent first wall panels 508 may be disconnected and folded down for storage and also adjacent first wall panels 508 may be disconnected and a second wall panel 510 may be slidably removed from the corner attachment assemblies 566 to remove the side wall 504 for access to the inner cavity 506 of the container 500 for unloading.

Preferably, the panels 508 and 510 may be formed of a blow molded polymer material such as high density polyethylene. The base 502 is thermal formed of high density polyethylene. The panels and base are preferably formed of a hollow core and filled with a polyurethane foam or other insulating material. Preferably, the base is reinforced with steel tubing for structural integrity. The panels include recessed portions 599 (FIGS. 8 & 9) to increase structural integrity.

Preferably, the edgelok coupling assemblies 530 and corner attachment assemblies 566 are formed of a plastic material such as polyvinyl chloride. The elongated flexible hinge 516 is preferably formed of a thermal elastomer material.

Although the present invention has been described with reference to preferred embodiments, workers skilled in the art will recognize that changes may be made in form and detail without departing from the spirit and scope of the invention.

What is claimed is:

1. A transport container comprising:

a base;

a plurality of side walls extending from the base, the side walls being adjacent to each other at edges to form a container having an inner cavity, each of the side walls being formed of a first wall panel and a second wall panel connected to the first wall panel by a hinge, adjacent first wall panels being selectively connectable and disconnectable to each other at edges of the side walls to allow the first wall panels to fold down relative to the second wall panels thereby shortening the transport container;

wherein at least one of the second wall panels is slidably connected to adjacent second wall panels by edge connectors such that the side wall with the slidably connected second wall panel may be slid in a direction essentially perpendicular to the base for access to the inner cavity, the edge connectors preventing the adjacent second wall panels from pulling away from the slidably connected second wall panel in other directions.

2. The transport container of claim 1, wherein the edge connectors include essentially perpendicularly oriented U-shaped panel attachment elements, said U-shaped panel attachment elements forming wall channels, said wall channels of the perpendicularly oriented U-shaped panel attachment elements being sized to slidably receive edge portions of adjacent second wall panels to perpendicularly support adjacent second wall panels.

3. The transport container of claim 2, wherein the U-shaped panels attachment elements have attachment flanges, and wherein the slidably received edge portions have smaller width portions which mate with the attachment flanges to prevent the slidably received edge portions from pulling away from the edge connectors.

4. The transport container of claim 1, wherein the edge connectors are attached to the base and extend upwardly from the base between adjacent second wall panels.

5. A transport container comprising:

a base;

a plurality of side walls extending from the base, the side walls being adjacent to each other to form a container having an open top and an inner cavity, each of the side walls being formed of a first wall panel and a second wall panel hingedly connected thereto by a hinge which seals against ambient air flow between the first wall panel and the second wall panel, the second wall panels being sealably connectable to the base and to each other; and cooperating edgeloks attached at edges of each of the first wall panels, the cooperating edgeloks being selectively connectable and disconnectable to allow the first wall panels to fold down relative to the second wall panels, the cooperating edgeloks extending the entire height of the first wall panels, the cooperating edgeloks being formed of plastic material and having a plurality of surfaces which mate to seal against air flow between adjacent first wall panels.

6. The transport container of claim 5 wherein each of the cooperating edgeloks comprises:

a wall attachment portion attached to an edge of a first wall panel; a latch extension moveably supported by the wall attachment portions;

an opposing wall attachment portion attached to an adjacent edge of an adjacent first wall panel for attaching adjacent edges of adjacent first wall panels together; and a latch channel defined in the adjacent edge of the adjacent first wall panel, wherein the latch extension can be moved to extend into the latch channel to selectively connect the wall attachment portion to the opposing wall attachment portion and moved out of the latch channel to allow disconnection of the wall attachment portion to the opposing wall attachment portion.

7. The transport container of claim 6 wherein the wall attachment portion comprises a U-shaped member with an extending edge portion, and wherein the opposing wall attachment portion comprises a U-shaped member with an extending edge portion, the U-shaped member of the opposing wall attachment portion being sized to receive the extending edge portion of the wall attachment portion with a slight interference fit, the extending edge portion of the opposing wall attachment portion being sized to be received with the U-shaped member of the wall attachment portion with a slight interference fit.

8. The transport container of claim 5 wherein the hinge connecting the first and second wall panels is elongated to extend from edge to edge across the entire width of the side wall.

9. The transport container of claim 5, further comprising:

a cover for closing and sealing the open top of the container.

10. The transport container of claim 9, wherein the cover comprises:

a relatively rigid portion sized smaller than the open top to the inner cavity of the container; and a flexible sealwing extending about an outer perimeter of the rigid portion, said rigid portion and flexible sealwing being dimensioned slightly larger than the open top for providing a tight seal between the sidewalls of the container and the cover of the container.

11. The transport container of claim 5, wherein the base includes a drain hole for draining liquid from an inner cavity of the container, and wherein the drain hole includes a check valve to seal the drain hole.

12. The transport container of claim 11 wherein the base includes a plurality of legs extending essentially perpendicularly downwardly therefrom, and wherein the drain hole extends through a leg.

13. The transport container of claim 5 wherein the wall panels and base are formed of a hollow core and filled with an insulating material.

14. The transport container of claim 5, wherein the hinge comprises a first contact extension connected to the first wall panel;

a second contact extension connected to the second wall panel; and an elongated flexible portion having a plurality of fold over segments extending between the first contact extension and the second contact extension.

15. The transport container of claim 5 wherein the hinge is formed of an elastomer material.

16. A transport container comprising:

a base;

a plurality of side walls extending upward from the base, the side walls being adjacent to each other at edges to form a container having an inner cavity, each of the side walls being formed of a lower panel contacting the base and an upper panel connected to the lower panel by a hinge to allow the upper panel to fold down relative to the lower panel;

wherein the lower panel of at least one of the side walls is slidably connected to the lower panels of adjacent side walls by edge connectors, such that the side wall with the slidably connected lower panel may be slid upward from the base for access to the inner cavity, the edge connectors preventing the lower panels of adjacent side walls from pulling away from the slidably connected lower panel in other directions.

17. The transport container of claim 16, wherein the edge connectors include essentially perpendicularly oriented U-shaped panel attachment elements, said U-shaped panel attachment elements forming wall channels, said wall channels of the perpendicularly oriented U-shaped panel attachment elements being sized to slidably receive edge portions of adjacent second wall panels to perpendicularly support adjacent second wall panels.

18. The transport container of claim 17, wherein the U-shaped panels attachment elements have attachment flanges, and wherein the slidably received edge portions have smaller width portions which mate with the attachment flanges to prevent the slidably received edge portions from pulling away from the edge connectors.

19. The transport container of claim 16, wherein the edge connectors are attached to the base and extend upwardly from the base between adjacent second wall panels.

* * * * *